US008876940B2

(12) United States Patent
Innes

(10) Patent No.: US 8,876,940 B2
(45) Date of Patent: Nov. 4, 2014

(54) SUPER INTEGRATED SECURITY AND AIR CLEANSING SYSTEMS (SISACS)

(75) Inventor: Stuart Martin Innes, Rosebank Gardens (AU)

(73) Assignee: SISACS Holdings Ltd. (NZ)

( * ) Notice: Subject to any disclaimer, the term of this patent is extended or adjusted under 35 U.S.C. 154(b) by 179 days.

(21) Appl. No.: 13/638,256

(22) PCT Filed: Mar. 30, 2011

(86) PCT No.: PCT/AU2011/000366

§ 371 (c)(1),
(2), (4) Date: Sep. 28, 2012

(87) PCT Pub. No.: WO2011/120091

PCT Pub. Date: Oct. 6, 2011

(65) Prior Publication Data

US 2013/0019747 A1 Jan. 24, 2013

(30) Foreign Application Priority Data

Mar. 31, 2010 (AU) ..... 2010901355

(51) Int. Cl.

| | |
|---|---|
| ***F24F 3/16*** | (2006.01) |
| ***F24F 1/00*** | (2011.01) |
| ***F24F 11/00*** | (2006.01) |
| ***F24F 7/08*** | (2006.01) |

(52) U.S. Cl.

CPC ..... *F24F 7/08* (2013.01); *F24F 11/0001* (2013.01); *F24F 3/16* (2013.01); *Y10S 55/34* (2013.01)

USPC ..... 95/1; 55/385.2; 55/DIG. 34; 95/273; 96/417; 454/27; 454/229; 454/239

(58) Field of Classification Search

USPC ..... 55/385.1, 385.2, DIG. 34; 454/187, 237, 454/239, 256; 62/231, 186; 95/2, 70, 74; 96/18, 25, 31, 39, 55; 361/230–235

See application file for complete search history.

(56) References Cited

U.S. PATENT DOCUMENTS

| | | | | |
|---|---|---|---|---|
| 5,516,330 | A | 5/1996 | Dechow et al. | |
| 5,881,806 | A * | 3/1999 | Rudd | 165/244 |
| 7,226,496 | B2 * | 6/2007 | Ehlers | 95/2 |
| 7,226,497 | B2 * | 6/2007 | Ashworth | 95/70 |
| 7,397,363 | B2 | 7/2008 | Joao | |
| 7,669,433 | B2 | 3/2010 | Yoon et al. | |
| 8,583,289 | B2 * | 11/2013 | Stack et al. | 700/278 |
| 2001/0010266 | A1 | 8/2001 | Rayburn et al. | |
| 2003/0100257 | A1 * | 5/2003 | Uchioke et al. | 454/187 |
| 2006/0030257 | A1 * | 2/2006 | Belady | 454/187 |
| 2006/0052047 | A1 * | 3/2006 | Daniels, II | 454/237 |
| 2007/0045439 | A1 * | 3/2007 | Wolfson | 236/49.3 |
| 2007/0117503 | A1 * | 5/2007 | Warminsky | 454/187 |

(Continued)

FOREIGN PATENT DOCUMENTS

| | | |
|---|---|---|
| JP | 2002-360680 | 12/2002 |
| JP | 2002-360680 A | 12/2002 |
| WO | WO2011/120091 A1 | 10/2011 |

*Primary Examiner* — Duane Smith
*Assistant Examiner* — Minh-Chau Pham
(74) *Attorney, Agent, or Firm* — Jill A. Jacobson

(57) ABSTRACT

The present invention provides an air cleansing system that removes the polluted air and controls the air temperature. This system may by optionally integrated with other systems including security, surveillance, smoke alarms and the like.

25 Claims, 16 Drawing Sheets

SISACS – Ducting Diagram

(56) References Cited

U.S. PATENT DOCUMENTS

| | | | | |
|---|---|---|---|---|
| 2009/0099696 | A1* | 4/2009 | Artman et al. | 700/276 |
| 2010/0126208 | A1* | 5/2010 | Stammer et al. | 62/419 |
| 2011/0281516 | A1* | 11/2011 | Newcomer | 454/231 |
| 2011/0319006 | A1* | 12/2011 | Gilder | 454/184 |
| 2012/0003916 | A1* | 1/2012 | Iwase et al. | 454/239 |
| 2012/0034861 | A1* | 2/2012 | Skrobek | 454/239 |
| 2012/0247748 | A1* | 10/2012 | Mise et al. | 165/237 |
| 2013/0040549 | A1* | 2/2013 | Douglas et al. | 454/239 |
| 2013/0040550 | A1* | 2/2013 | Pfister et al. | 454/239 |
| 2013/0095744 | A1* | 4/2013 | McKie et al. | 454/251 |
| 2013/0281000 | A1* | 10/2013 | Newcomer | 454/237 |
| 2013/0324026 | A1* | 12/2013 | Fiorita, Jr. | 454/187 |

* cited by examiner

SISACS – Ducting Diagram

SISACS – Wiring Diagram

SISACS – Twin Chamber Wall Unit (TCWU)

Varying designs of possible TCWU options.

SISACS – Automated Smart Panel (ASP)

SISACS – Thermostat Locator

SISACS – Topographical analysis. (How SISACS looks installed in a home).

Standard home without SISACS.

Standard home WITH ...SISACS

SISACS – Induction system

SISACS – Extraction system

SISACS - Induction and Extraction Roof (or Wall) Alignment

SISACS – Induction 'Ducting' system

SISACS – Bluetooth and wiring diagram to the MCU/CECM

SISACS – Smoke Alarm zones

SISACS – Laser Observation Window (LOW) System. - (OPTIONAL)

SISACS – Camera surveillance (CCTV) – (OPTIONAL)

CO2 filtration and In-Line Generator placement

SUPER INTEGRATED SECURITY AND AIR CLEANSING SYSTEMS (SISACS)

CROSS-REFERENCE TO RELATED APPLICATIONS

This application is a U.S. national stage application under 35 U.S.C. §371 of PCT/AU2011/000366, filed on Mar. 30, 2011 and published as WO2011/120091 on Oct. 6, 2011, which claims priority to Australian application no. 2010901355, filed on Mar. 31, 2011.

FIELD OF THE INVENTION

The invention relates to air conditioning, heating and air re-circulation systems in the building industry, particularly to cleansing static air pollution, and integrated systems therein.

BACKGROUND OF THE INVENTION

Many domestic, commercial and industrial areas worldwide are currently fitted with air conditioning and/or heating units that pump either cold or hot air into an enclosed area. Premises which are not fitted with these units also have build up of cold or hot air naturally. In both of these situations, the air is trapped inside the premises and quickly becomes stale as a result of occupants breathing, coughing, smoking, or as a result of cooking, bathroom or other household odours. This leads to collection and circulation of stale air resulting in severe air pollution which may cause symptoms of illness and ailments such as sore throats, headaches, stinging eyes, flu and colds because of trapped air germs introduced by people in the area contaminated by unhealthy living and working conditions. Consequently this problem casts billions of dollars in lost productivity and rising medical bills worldwide. In the elderly and infirm and those with respiratory related, problems, this air pollution can be fatal. The medical evidence for polluted air within buildings is well documented. A greater and more severe condition has recently arisen in the form of swine flu and bird flu, both being transmitted by humans and rapidly passes on in unhealthy enclosed areas, requiring occupants to place face masks to prevent inhalation of germs.

Furthermore, households can be a further risk in addition to state and entrapped air by not having air correctly balanced not only within the living areas but also within the ceiling cavity which either cools or heats up. Consequently, the trapped air warms or cools the ceiling which transfers into living areas resulting in further cooling or heating of these areas.

Efforts to solve this problem include fitting ceiling insulation products designed to reflect incoming heat through the roof or to prevent transmission of cold air from the outside into the internal parts of the house.

It is an object of the invention to provide an air cleansing system that removes the polluted air and controls the air temperature, whilst continually interacting with existing air conditioning or heating systems through an intelligent electronic module known as Super Integrated Security and Air Cleansing System or SISACS®.

SUMMARY OF THE INVENTION

The present SISACS® invention provides an integrated system comprising a central electronic control and monitoring unit (CECM);

a twin chamber wall unit (TCWU); and a master control unit (MCU), wherein the CECM controls and monitors all electronic functions of the invention, the TCWU regulates the flow of air in and out of the interior environment zone, and the MCU is the programming device to the CECM.

Preferably, the flow of air is controlled by extraction and induction systems.

Preferably, the TCWU comprises two columns A and B each fitted with top and bottom vents.

Preferably, the top vent in column A opens to extract warm air out whilst the bottom vent in column B opens simultaneously to introduce cool air into the room, to regulate and maintain the temperature in warm conditions. This is a unique feature as the standard air conditioning practice is to feed cold air into an interior environmental zone through ceiling vents. The SISACS® system adheres to the principal of cool air always located below warm air and so the introduction of cool low into an interior environmental zone and hot air being extracted at the top has proven to be many more times efficient in terms of a zone quickly achieving the desired temperature, thereby resulting in less energy use required to reach those temperatures.

Preferably, the bottom vent in column A opens to extract cool air out whilst the top vent in column B opens simultaneously to introduce warm air into the interior environmental zone, to regulate and maintain the temperature in cool conditions. The SISACS® system adheres to the principal of warm air always located above cool air and so the introduction of warm air at the top and the cool air being extracted at the bottom is more efficient.

The vents in the TCWU are fitted with electronic motors (dampers) and controlled by the CECM to open and close as it reads the signals sent from the thermostats and air quality meters located in the TCWU.

Preferably, the TCWU signals the CECM to activate a split system air conditioner by blue tooth, infrared signal, hard wiring or any other communication means to achieve and maintain a desired temperature directly from the CECM.

Preferably, TCWU signals the CECM to activate split system gas, electric or reverse cycle refrigerated air conditioning/heating to achieve and maintain a desired temperature also by blue tooth, infrared signal, hard wiring or any other communication signal directly from the CECM.

Preferably, a blue tooth, infrared, hard wired or other communication signal sensor switches on the air conditioner or heater.

Preferably, the TCWU signals the CECM to activate a reverse cycle air conditioning unit to achieve and maintain a desired temperature within an interior environmental zone.

In another aspect, the invention provides a method of purifying air in a room comprising a system according to the present invention as described above.

Preferably, the TCWU further comprises a smoke alarm.

Preferably, the TCWU further comprises a intruder alarm.

Preferably, the intruder alarm comprises of one LED row of lights on the TCWU panel and a directional sensor.

Preferably, the TCWU further comprises a closed circuit television.

Preferably, the SISACS® invention device refreshes the environment on a regular basis.

In another aspect, the present invention provides an integrated cooling and/or heating system which is connected to a separate electronic unit which controls the flow of clean air into a room and regulates and controls the air temperature in a room or rooms.

Preferably, the above integrated system comprises:

a central electronic control and monitoring (CECM) unit;

a twin chamber wall unit; TCWU) and a master control unit (MCU), wherein the CECM controls and monitors all electronic functions of the invention; the TCWU regulates the flow of air in and out of the interior environmental zone and the MCU is the programming device to the CECM.

Preferably, the system or method according to the present invention further comprises a kinetic energy source generated by the expulsion of air from an extractor unit enabling the capture of such air to be directed to propel a fan attached to a magnet alternator or other device to produce free electricity.

Preferably, the system or method according to the present invention further comprises a filtration system for carbon dioxide collection but not limited to only carbon dioxide gas.

Preferably, the invention incorporates a carbon dioxide collection filtration system to be fitted to both inline air streams on the induction and extraction units where a membrane or other collection unit or capture device would be located to recover or collect carbon dioxide from the ambient air passing through, over or around the system. A collection system for other obnoxious gases may well be developed for incorporation into the same or similar design.

Preferably, the Central Electronic Control Unit (CECM) is capable of monitoring and relaying the liters of ambient air passing over such a filtration system and/or monitoring the carbon capture filtration unit electronically for the purpose of claiming carbon credits.

BRIEF DESCRIPTION OF THE DRAWINGS

A brief description of the figures according to the present invention follows.

DETAILED DESCRIPTION OF THE INVENTION

Figure 1:
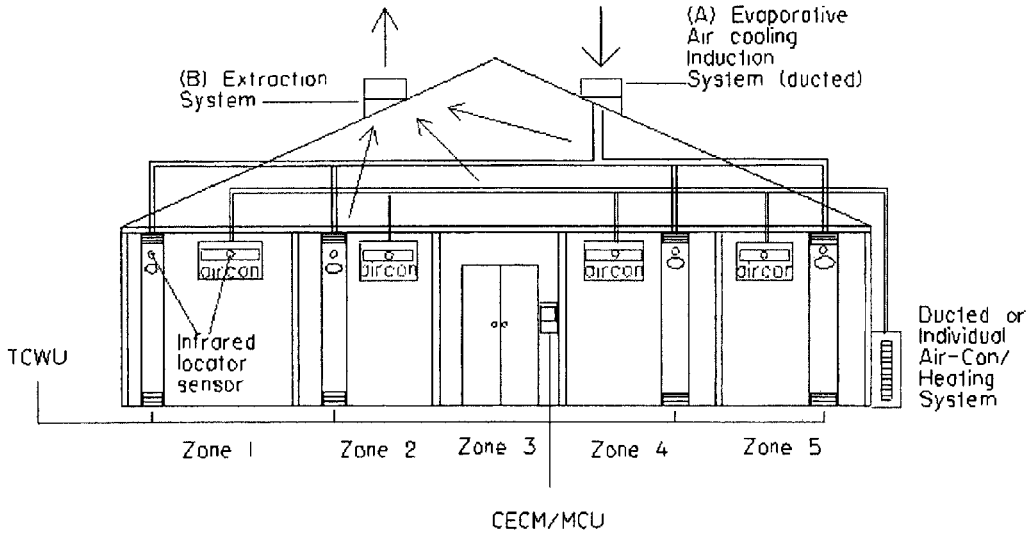
FIG. 1 illustrates the SISACS® ducting system

The present invention provides an air cleansing system that introduces 100% filtrated air from the outside and simultaneously removes polluted air from the interior of the environmental zone whilst maintaining pre programmed air temperatures. The system incorporates automatic back to base smoke alarms, intruder alert, an optional surveillance CCTV system, a carbon dioxide filtration unit and an in line kinetic energy recovery system for producing electricity from the spent air in the extraction unit.

The invention primarily relies on the process of induction and extraction of air to control the temperature in an enclosed area such as a room or rooms in a family house but is equally capable of operating in environmental zones situated in a multi storied commercial building or office complex. To achieve this the SISACS® invention incorporates within its system a unit that has an evaporative air conditioning unit as its primary source but integrated with a refrigerated air unit. The evaporative unit always operates when the system is activated and is inducting clean air through its water filtration system which in turn can reduce internal temperatures to around 24 degrees Celsius. The need for lower temperatures is achieved by SISACS® automatically recognising that the programmed temperature has not been achieved, or alternatively by receiving manual instructions into the MCU to activate the refrigeration system in conjunction with the evaporative air unit which will front end supply the refrigerated unit with cool air and maintain the air volume. A system installed with only the evaporative air unit or only the refrigerated unit is possible but not as desirable. Integrated gas, electric, or other forms of heating used to warm the premises can also be installed where other heating systems are not present and this is controlled by the CECM as part of the SISACS® system. The induction unit has variable speed motor that is also controlled by the CECM. Equally, an extraction unit of the same power is incorporated into the system which removes internal air through the TCWU (Column B) and is controlled by the CECM. This induction and extraction of air negates the need to open windows to remove the vacuum build up which can make the premises a security risk. If the SISACS® invention has only been installed with an evaporative air unit, the CECM unit can be directed to interact with other existing refrigerated air conditioning and heating systems causing them to switch on and off as air quality and temperature is reached. This will save energy as the SISACS® system will continue operating the evaporative air unit. The interaction with these refrigerated air conditioning and heating units is necessary to take temperatures lower than the evaporative unit or take advantage of the heating system within the refrigerated air conditioning unit, or a separately fitted heating unit. This is achieved through the use of blue tooth, infrared, hard wired or other communication signals that activate thermostats preferably within the TCWU which monitor set temperature levels.

Balancing the roof cavity with a temperature similar to the internal parts of the premises creates perfect insulation besides being environmentally responsible. This is achieved by the extraction system moving either warm or cool internal air into the roof cavity through the TCWU in each room before expelling it outside. This tends to balance the roof cavity to the internal room temperature. By maintaining warm or cool air in the roof cavity can help reduce the constant use of air conditioning or heating units and thereby save energy. A temperature balanced roof cavity that is maintained at a similar level to that required within the interior zone of a premise and at the same time, will act as natural insulation and will help provide stable air temperatures throughout the building.

The present invention is based on the fact that by automatically balancing air and temperature conditions throughout a building including the roof cavity, and by expelling bad and polluted air continually from such buildings whilst introducing new clean air will provide a refreshing and healthy environment to live and work in.

The integrated SISACS® system comprising the CECM unit, the TCWU and the MCU may be built and operated as individual units or built and operated as conjoined units. For example, the CECM and the MCU may be combined to function and operate as a single unit, or separated into two individual units.

Extraction System

The extraction system is an electronically controlled unit installed onto the highest exterior part of the roof available or installed into the interior of the roof cavity to draw on surrounding air before expelling it. Both methods will draw internal air up through the ducting and into the roof cavity. The unit is equipped with a variable speed motor that runs preferably on AC power but controlled by the CECM. It is possible to operate such and extractor on DC power or solar energy. It is referred to as Column B. This unit receives signals from the CECM when to speed up or slow down. This signal is transmitted when either a zone or multiple zones are shut down via the MCU in which case the motors will slow down, or alternatively they will speed up if new zones are programmed to operate. The extraction unit creates suction within the roof cavity that in turn draws air up. Column B of every TWCU through the vents from the interior of the premises. Installation of the extractor unit calls for the roof cavity to be sealed as much as possible to ensure the only available air for extraction is via the ducting.

Induction System

The induction system is an electronically controlled unit installed onto the exterior part of the roof or mounted at ground level on the exterior of a premise. It will operate efficiently if mounted elsewhere on or within the premise as long as it has outside ambient air to draw on. The unit is equipped with a variable speed motor that runs preferably on AC power but controlled by the CECM. It can be operated on DC power or solar energy. It is referred to as Column A. This unit receives signals from the CECM when to speed up or slow down. This signal is sent when either a zone or zones is shut down via the MCU in which case the motors will slow down, or alternatively they will speed up if new zones are programmed in.

SISACS® (Super Integrated Security and Air Cleansing System)

SISACS® comprises three main driver components which form part of the present invention in addition to the extraction and induction systems. The new components are:

1. CECM: Central Electronic Control and Monitoring unit;
2. TCWU: Twin Chamber Wall Unit; and
3. MCU: Master Control Unit.

CECM

The CECM component preferably forms part of the MCU, but not necessarily, and is an electronic hard drive that deciphers instructions programmed manually or automatically into the MCU. Preferably, it is positioned in a convenient part of a premise such as the wall close to an entry door.

FIG. 1 illustrates the Induction ducting and Extraction systems in use.

The CECM is designed to intelligently monitor the overall temperature of the environment through the thermostats and air quality meters preferably located in every TCWU and to co-ordinate both the induction and extraction systems to work simultaneously. It can be integrated to operate and control any alternate refrigerated air conditioning unit fitted within the premise and would be connected to it via Bluetooth, infrared, hardwiring signals or any other means of electronic communications capable of activating it as required or shut it down. When operating, the unit will systematically cleanse the enclosed environment with fresh air, whilst maintaining the desired temperature and air quality.

The CECM monitors and controls the induction, extraction, TCWU (including the automated vents, thermostat, air quality meters, LCD, smoke alarm, security alarm (optional) and CCTV) through the CECM unit. It will monitor liters of air passing through the induction and extraction units whilst reading the carbon dioxide or other gases as programmed and collected in its filtration system. Power generated by a free flowing fan located in the extraction duct will spin a magnet alternator that in turn will return power to the power grid or battery banks and this energy is also controlled and monitored by the CECM. The unit can be fitted with an Uninterrupted Power Supply (UPS) to correctly shut down the full SISACS® system in the event of a power outage.

TCWU

Figure 3:
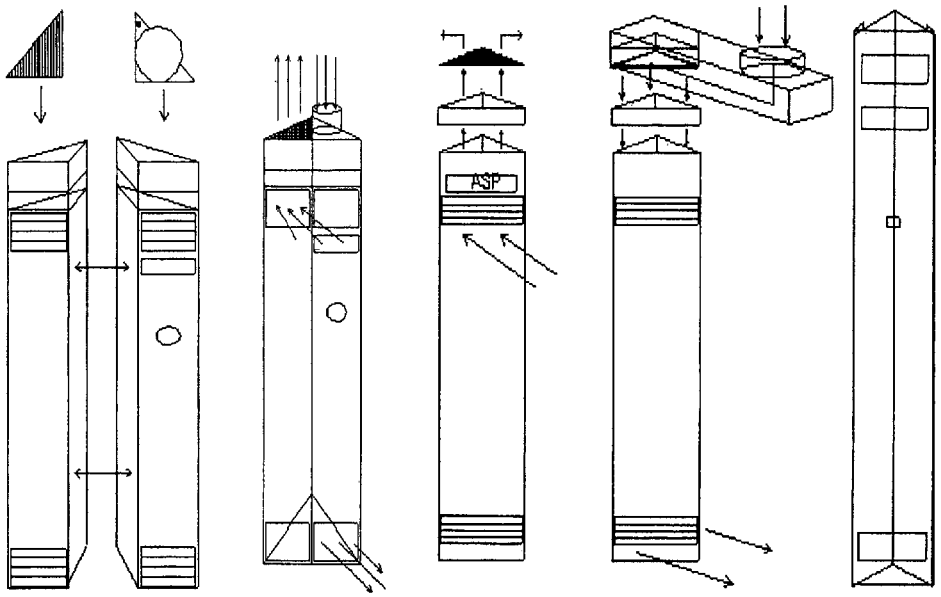
FIG. 3 illustrates the Twin Chamber Wall Unit (TCWU)

The TCWU component (FIG. 3) is designed to be internally fitted into a new wall or retro-fitted externally to an existing construction. Both fittings have the same features and options. The two units comprise columns A and B. By preference the retro-fit unit is triangular shaped and fits unobtrusively into the corner of a room.

The internal wall TCWU comprises of an internal backing plate designed to make the unit air tight so as to optimise both its induction and extraction capability. The fascia of the unit will be plaster board, preferably, or similar facing, normally used to cover internal walls under new construction. The backing plate is engineered and braced to meet all building regulations as it is integral to the strength of the frame that supports it. The TCWU will be constructed with electronics in place to handle the operations of the four automated vents, the thermostat, air quality meters, LCD screen and accessories such as the smoke alarm, infrared remote air conditioner activator, optionally security alarm and CCTV and any other device added to the system. Power activation may be Bluetooth, infra red, hardwired or any other communications means that can activate the TCWU systems and signals to the CECM.

The external TCWU for retro-fitting is exactly the same as the internal unit; however, it will have a pre-formed decorative fascia plate and will by preference be of a triangular shape to fit unobtrusively into the corner of a room.

MCU

Figure 2:
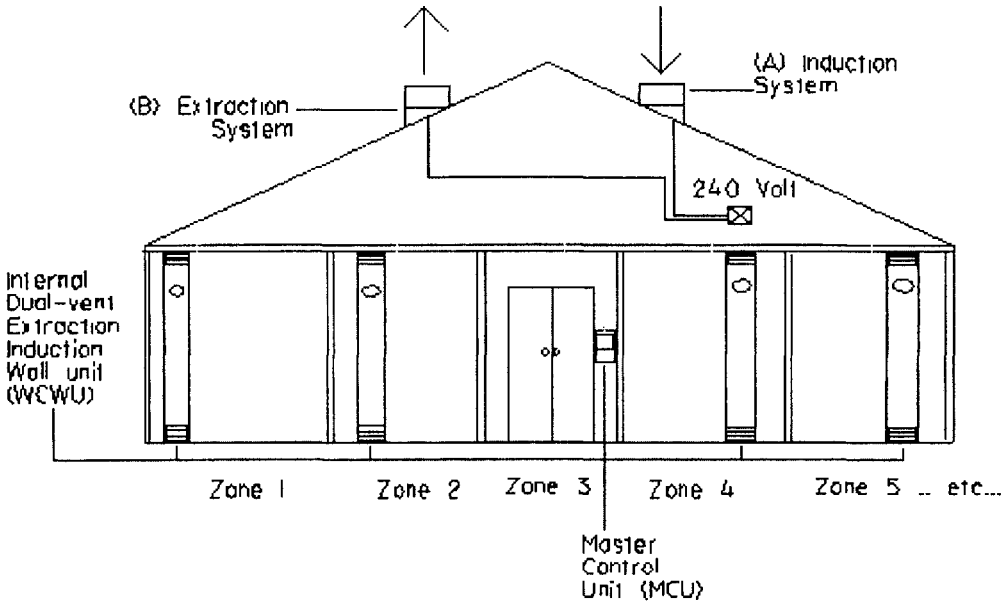
FIG. 2 illustrates the SISACS® wiring system

The master control unit (MCU) (as shown in FIGS. 1 and 2) forms part of the CECM and is fitted in a convenient place within the interior of the premises, such as a wall close to an entry or exit door. In essence, it is the activation device for the CECM. The MCU enables the user to control all the zones, including all of their functions, where the TCWU's are located. A master switch will enable the MCU to automatically, or manually, control the temperature, refresh rate, timer mode, emergency reset button and all other standard or optional functions that may form part of the SISACS® configuration.

Figure 4:
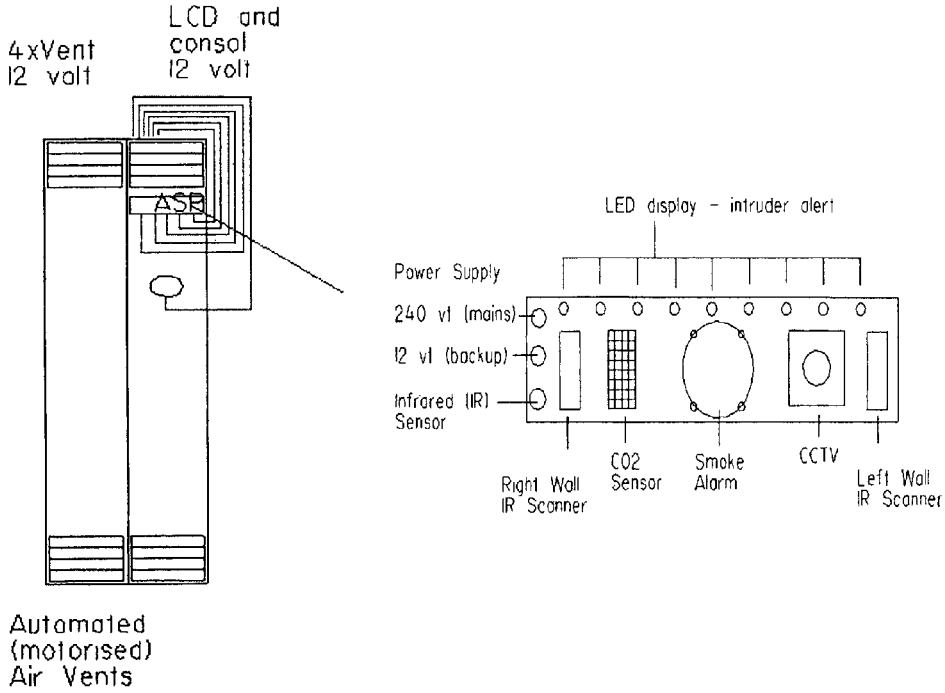
FIG. 4 illustrates the Automated Smart Panel (ASP)

FIG. 4 illustrates the SISACS®—Automated Smart Panel (ASP). This panel includes indicators such as the LED Intruder alert, the power supply, the IR sensors, the $CO_2$ sensor or other gas meters, smoke alarm and the CCTV.

Figure 5:
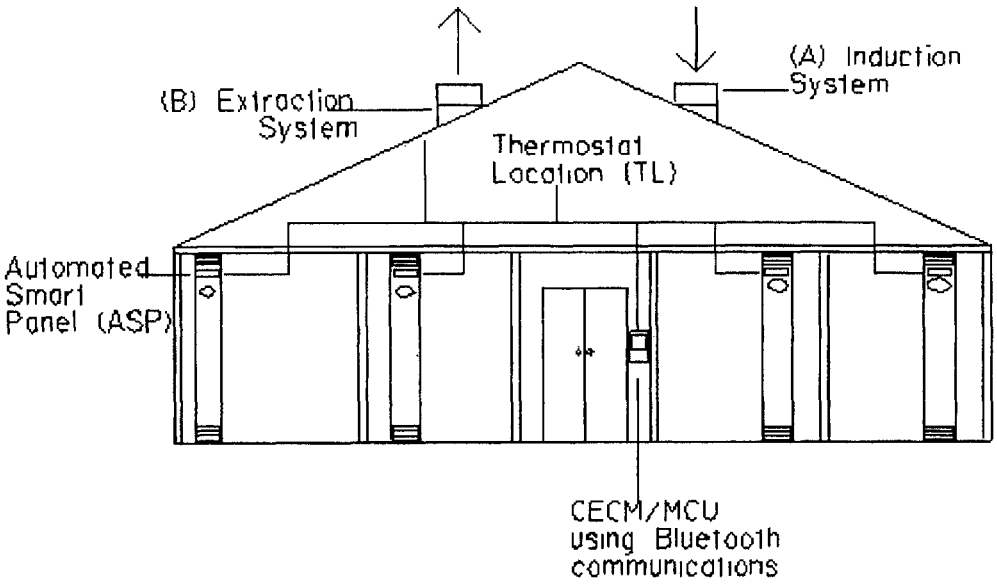
FIG. 5 illustrates the SISACS® Thermostat Locator

FIG. 5 illustrates an example of a plan for Thermostat Locators at various locations throughout the building.

Figure 6:
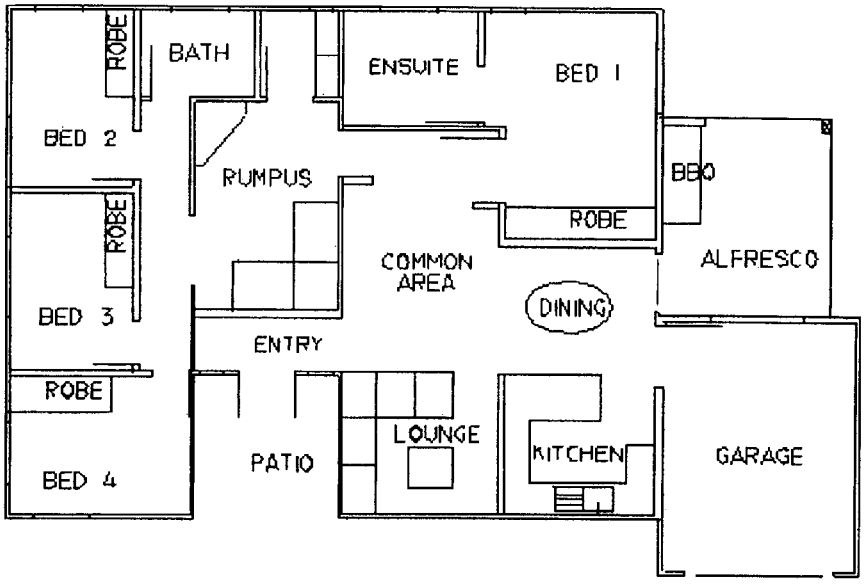
FIGS. 6, 7, 8, 9, 10, 11, 12, 13, 14, 15 and 16 illustrate the SISACS® to topographical analysis showing how SISACS® looks when installed in a typical home.

FIG. 6 illustrates an example of a floor plan for a typical home without SISACS®.

Figure 7:
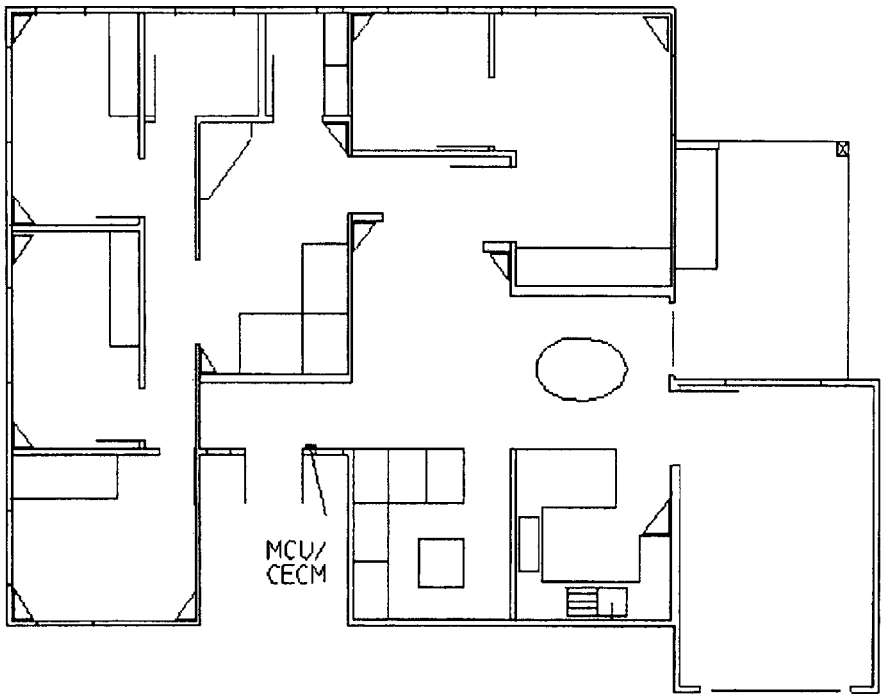

FIG. 7 illustrates an example of a standard home with SISACS® fitted, and shows an example of the location of the MCU/CECM unit.

Figure 8:
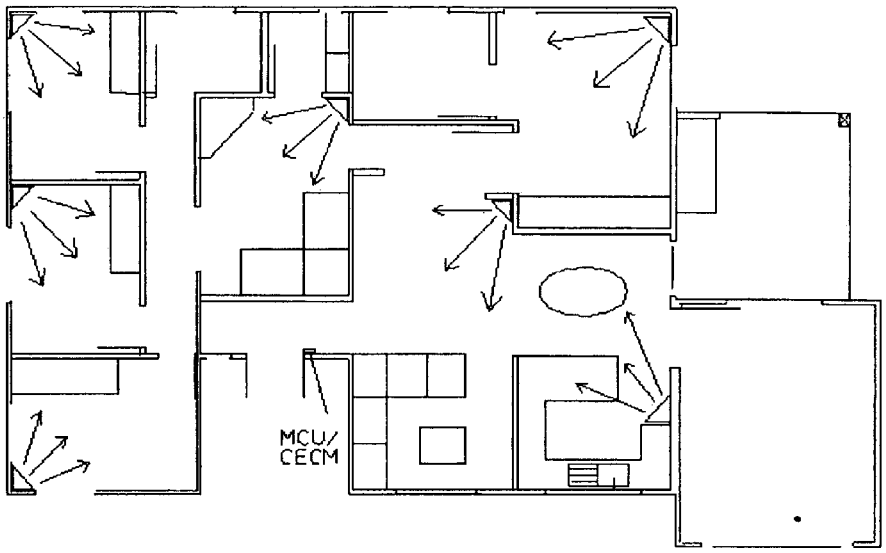

FIG. 8 illustrates an example of air flow with the Induction system or unit in operation.

Figure 9:
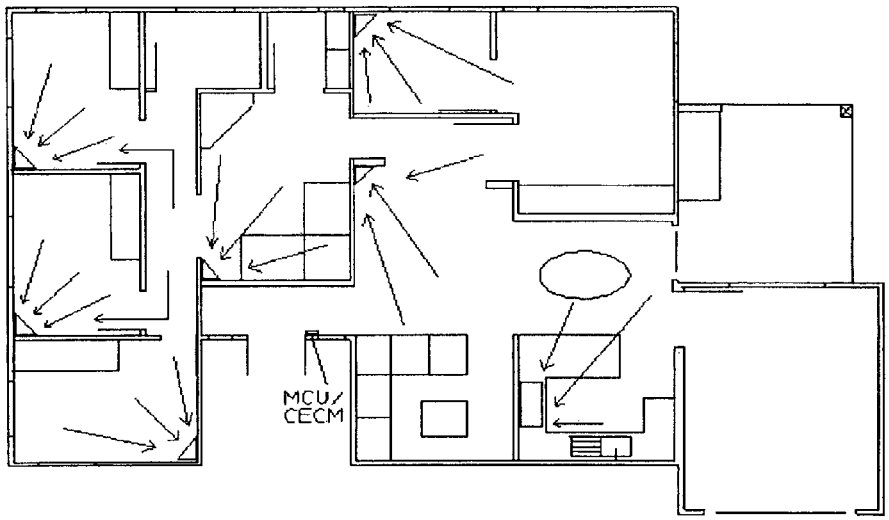

FIG. 9 illustrates an example of air flow with the Extraction system or in operation.

Figure 10:
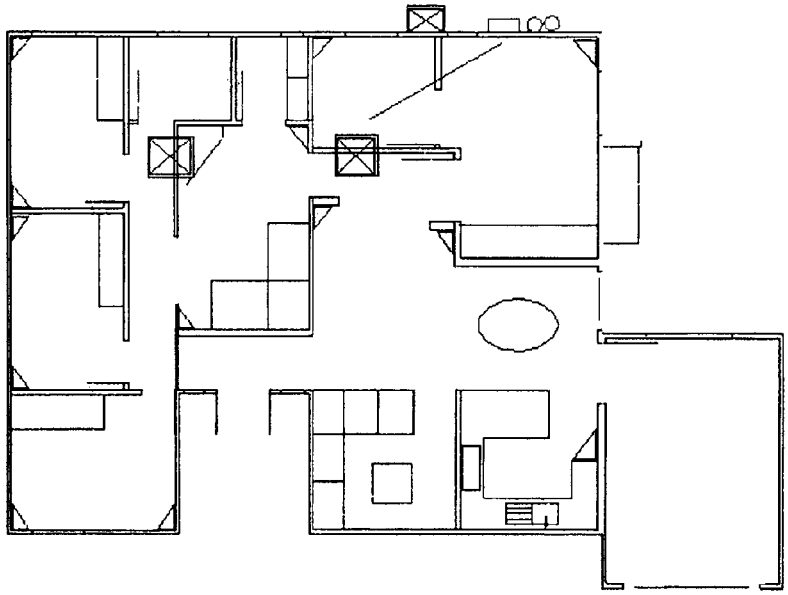

FIG. 10 illustrates an example of Induction and Extraction. Roof (or Wall) Alignment.

Figure 11:
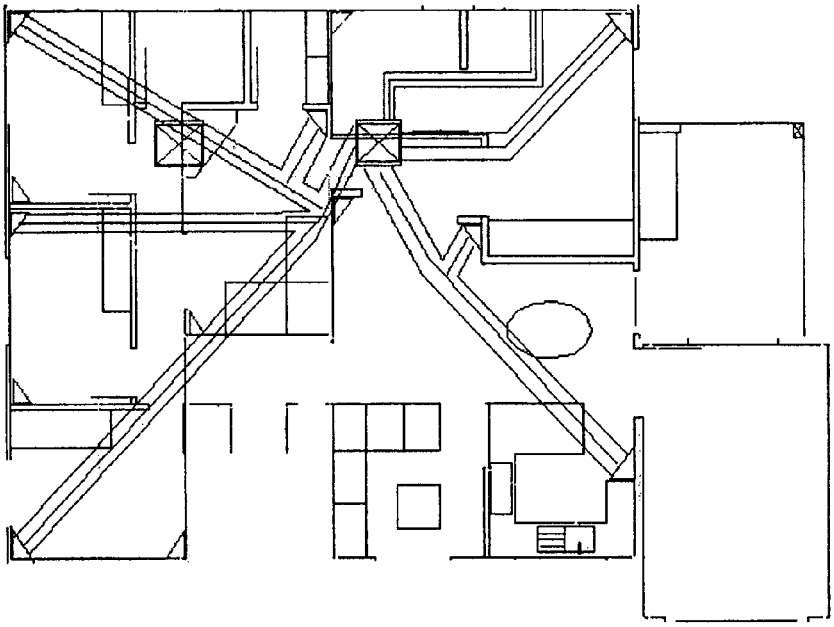

FIG. 11 illustrates an example of the Induction 'Ducting' system.

Figure 12:
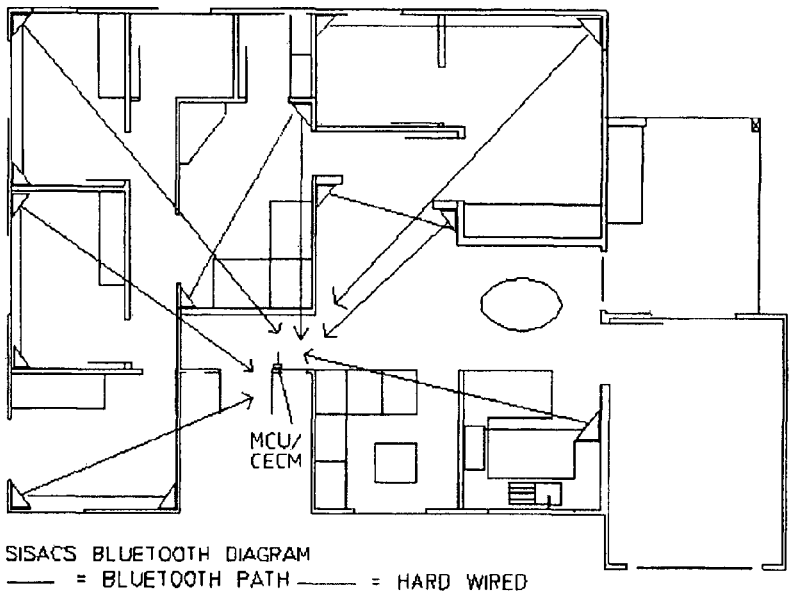
Figure 13:
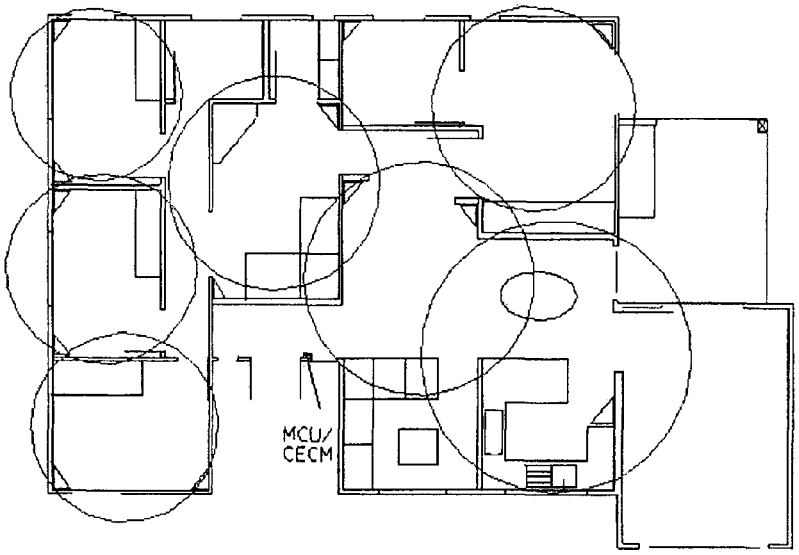

FIG. 12 illustrates an example of the Bluetooth and wiring diagram to the MCU/CECM FIG. 13 illustrates an example of the Smoke Alarm zones.

Figure 14:
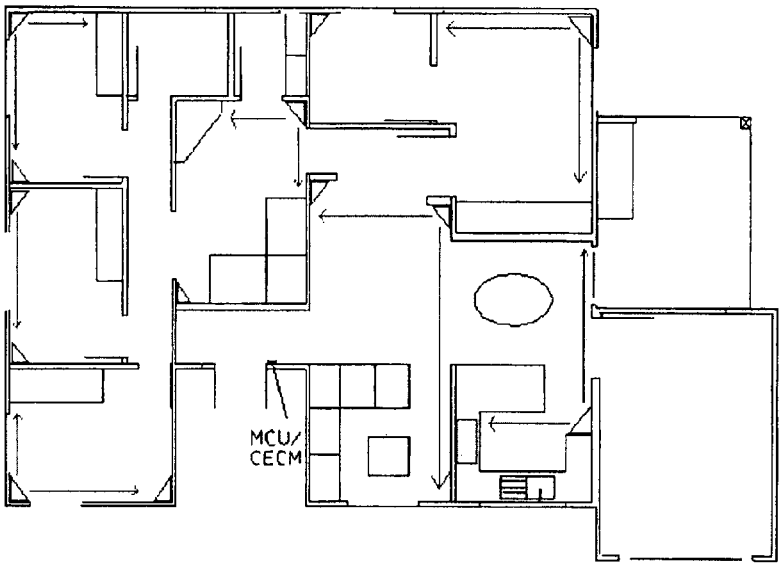

FIG. 14 illustrates an example of the Laser Observation Window (LOW) System.

Figure 15:
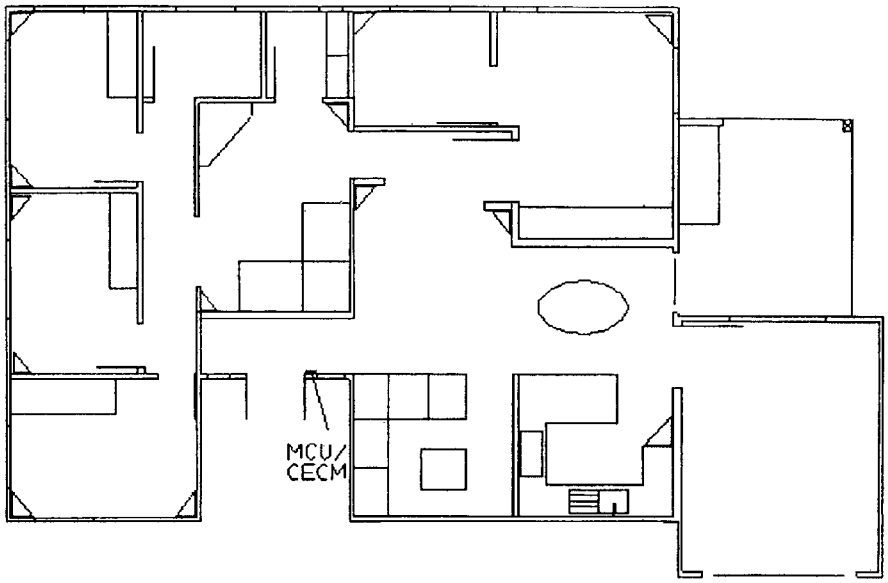

FIG. 15 illustrates an example of the Camera surveillance (CCTV) opportunity.

Figure 16:
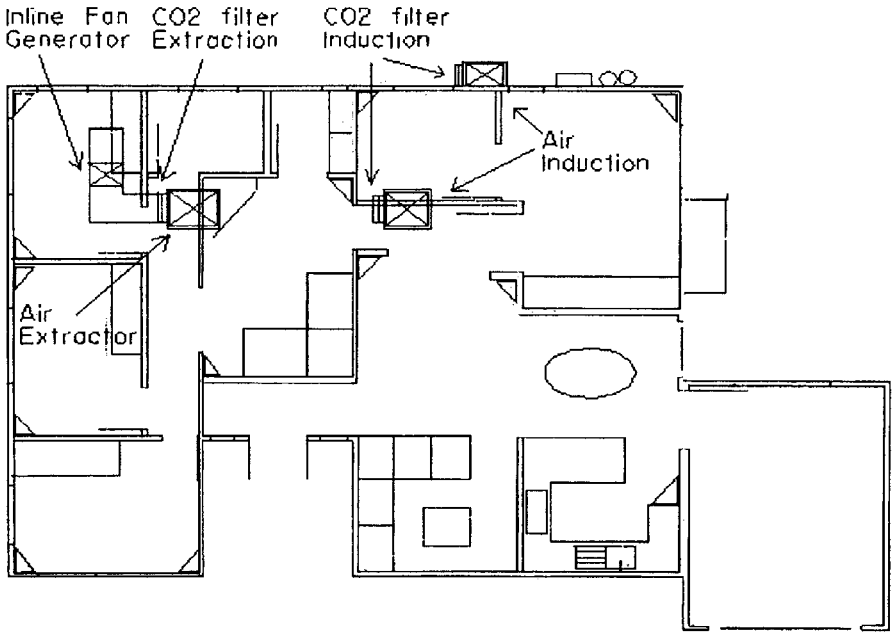

FIG. 16 illustrates an example of the $CO_2$ filtration units and the In-Line kinetic energy generator placement.

SISACS® Set Up and Operation

Fire Safety (Smoke Alarm)

Every TCWU is fitted with a smoke alarm which is constantly monitored by the CECM. The smoke alarm is positioned on every TCWU panel. In the event of smoke being detected in a zone the relevant smoke alarm will activate. The CECM will immediately shut down the SISACS® system, closing all vents and turning off any heating or air conditioning systems. If the smoke alarm is not reset on the TCWU panel reset button within two minutes, the CECM will dial a preset number attached to the local emergency communications centre advising a phone number, street address and fire alert.

Security Alarm

The LCD control unit on the TCWU comprises an alarm system. This alarm comprises of one LED row of lights on the TCWU panel and a directional sensor. The unit can be programmed at the MCU in any zone as required. If the sensor is activated, the row of LED lights is switched on and a distinguishable signal is relayed via the CECM to the zone of activation. The LED lights will remain on for two minutes before switching off. The zone of interest can be readily identified at the MCU LED display window. The alarm is manually reset at the MCU controller.

CCTV (Optional)

Pin hole surveillance cameras can be fitted to the TCWU panel and controlled through the CECM. These would be activated by movement and would require a separate DVR recorder. Provision has been made for retro fitting this type of equipment.

Set Up

1. Set desired temperature to all the zones of the premises manually via the MCU.
2. Program the refresh rate (eg, half-hourly) to remove and replace old, stale air. Alternatively set on automatic for continuous running.
3. Set security accessories to operational.
4. Enter phone number and street address details into the CECM via the MCU for the SISACS® system to call the fire service automatically in the event of an unanswered smoke alarm activation.
5. Set the automatic timer to switch on and off at desired times, or to operate continually. The user may also dial into the system to activate it remotely via the CECM's internal modem and set a mode of operation from a remote location.

Operations

1. In automatic mode the CECM reads the thermostats and air quality meters in the TCWU's.
2. The CECM directs both the induction and extraction systems into a start up mode of operation.
3. Summer operating controls: the top vent of column B (3) will open and the hot air entrapped in the room, and which has risen, will be extracted out of the room. Simultaneously, the bottom vent in column A (2) will open introducing cool air into the room, pushing the warm air upwards, as the extraction pulls the cooler air upwards at the same time.
4. If the desired temperature has not been achieved by the evaporative air conditioner, the TCWU will signal the CECM to activate the nearest refrigerated air conditioner (AC), if fitted, to be switched on via the Bluetooth, Infrared (IR) sensor, hardwiring or any other electronic communication device capable of sending the correct signal.
5. Once the desired temperature is reached, the TCWU will switch the AC off. The induction and extraction motors will slow down but continue to recycle evaporative air in the zone. When the temperature commences to rise past the desired setting, the thermostat in the TWCU will signal the CECM which in turn will send a Bluetooth, infra red hardwired or any other electronic communications signal fitted to start the refrigerated air conditioner, thereby maintaining zone temperature settings.
6. Winter operating controls: the bottom vent in column B (4) will open and the cold air in the zone will be extracted. Simultaneously, the upper vent of column A (1) will open introducing warm air into the room, and pushing the colder air downwards, as the extraction system is pulling the cold air out through the bottom vent at the same time.
7. If the desired temperature has not been reached, the CECM will receive a signal from the thermostat in the TCWU and will send a Bluetooth, infra red, hardwired or any other electronic communications signal to the nearest heater, if fitted, to be activated.
8. Once the desired temperature is reached, the CECM will switch the heater off after receiving a signal from the thermostat in the TCWU.

The above operation system is based on a standard remote controlled split AC/heater system. In the event that ducted cooling/heating unit is in use, the CECM will control this unit also and in a similar manner.

Refresh Rate Program

It is important for efficient use of the system that every environment is refreshed continuously. The refresh rate is programmed into the MCU manually for intermittent operation or automatically for continuous operation. This step is especially important in commercial applications, such as schools, hospital and restaurants, where excessive carbon dioxide accumulates.

EXAMPLES

1. Induction Unit

The induction unit is a 100% clean air filtrated, cold front evaporative/refrigeration type producing between 800 and 1200 liters of air per second. Usual operating speed would be by preference, 1000 liters of air per second. However this invention could be operated with greater or lesser liters per second. It is versatile enough to operate from either an external or internal position. If operated internally, an open mesh grid floor must support the induction unit to allow for air supply. A heating unit or supply can be incorporated into the invention to deliver warm air in the same manner as cool air. Ducting is attached to the unit which is fed preferably into the roof cavity to connect with ducting boxes that align with the top of internal wall sections. The ducting boxes are sealed onto the top of the wall cavity to allow air produced by the induction unit to flow down into the wall cavity. A Carbon Dioxide collection system either in the form of a membrane or other device is fitted to the in line air stream to recover carbon dioxide, but other areas within the system could equally be used to capture the air flow. Other types of filtration could also be incorporated in line to filter other obnoxious gases.

2. Wall Cavity and Ducting for the Induction Unit

The top of the wall cavity and the internal horizontal bracing are specially designed and made from steel for strength and galvanized for longevity. They are ventilated to allow air to pass through them. The outside wall cladding and the inside wall lining can be standard building materials commonly used. The area over which the ducting boxes sit and feed air into the wall cavity are sealed by the internal wall studs within the framed section being used and by the internal and external wall linings. This type of ducting is ideal for a new build, but a retro fit can also be considered by constructing corner units into a room that lead into the ceiling in the same manner as an internal wall duct. They are connected and vented in the same manner as a new build unit using the internal wall ducts. These retro fit units can be constructed using timber or steel frames and do not require the vented galvanized steel framing.

3. Induction Vents

The wall cavity into which the air is to be fed, is fitted with two vents on the internal lining. The first is situated just below the ceiling and the second is fitted just above the floor. This allows air being fed into the wall cavity from the induction unit to be released in a controlled manner. Both vents have actuators that are activated into an open or a closed position as a result of manually programming the desired settings into the SISACS® Master Control Unit.

Attached to the vents is wiring to a power source. This can be either AC/DC or any other power generated source. Because the vents are equipped with actuators, a power source is necessary and the wiring by preference runs up the internal duct into the roof cavity where it is connected to any available power source.

4. Operation of Induction Vents

When warm air is being introduced into a particular zone, the top induction vent will automatically open. The induction vent, at the bottom will remain closed, allowing warm air to enter the room through the top vent.

When cold air is being introduced into a particular zone, the bottom induction vent will automatically open. The induction vent at the top will remain closed, allowing cold air to enter the zone through the bottom vent.

The warm or cool air inducted into a zone is continually extracted at the same speed via the extraction vents located in the extraction ducting. (See No. 7 Wall cavity and ducting for the extraction unit). This is air management (See No. 9 Operation of the extraction vents).

5. Extraction Unit

The internal extraction unit draws air from around it within the roof cavity at the rate of 800 to 1200 liters per second. Units with a greater or lesser capacity could be used to operate this invention. By preference the extractor will operate at 1000 liters a second to harmonize with the induction units preferred operational efficiencies. The SISACS® extraction unit is mounted on a frame and onto a ducting box. The complete unit is then firmly attached within the roof cavity, by whatever means, to secure it in place. It consists of a centrifugal fan, but not necessary limited to that design, and an electric motor to drive it, which is connected to an available power source. The extraction unit does not necessarily need to be internally mounted and can be adapted so that it is attached to the external roof area to draw internal air to the outside of the roof cavity. The building design will dictate the best extractor option. The extractor fitted internally, sits on and is attached to a venting box with a chute that leads to the outside via a vent attached to the side of the premises. A carbon dioxide recovery membrane or other device is fitted to the in line air stream to recover carbon dioxide. The area of attachment for carbon dioxide membrane by preference will be on the side of the extractor expelling the air but is not limited to any other positions on either side of the unit. A self generating fan is located in the chute expelling air and is generating power from kinetic energy produced by the used air flow.

6. Operation of the Extraction Unit: Electricity Generation Utilizing Kinetic Energy The extraction unit is designed to run in harmony with the induction unit by preference at around 1000 liters of air per second. That is 1000 liters of air being inducted and 1000 liters of air being extracted. The design allows for the extractor to operate faster or slower than the induction unit, when required so as to move greater or lesser liters of air per second than the induction unit is producing and when directed to do so by the SISACS® Master Control Unit via the CECM. This feature ensures that a balanced air flow occurs within the zone. The air around the extractor within the roof cavity is drawn by the extractor into the extractors ducting system where it enters a chute that has a free flowing fan engineered into its design. The expelled air volume is kinetic energy passing over the blades of the fan causing them to spin. The fan is connected to a magnet alternator that produces free electricity. A wire is fed from the alternator to battery banks, if they are available, or to the electricity mains for return to the power grid. The energy generating fan can be of the centrifugal type or any other design that will produce energy and is compatible with the induction unit. Some variations of this may apply.

7. Wall Cavity and Ducting for the Extraction Unit

When the extractor is operating, it quickly removes the ceiling cavity air and must draw on a fresh supply. It obtains this air from the internal zones being fed by the induction unit below the ceiling cavity. To do this, the extractor ducting system is the same as that used for induction, that is, internal wall cavities. Usually a wall opposite, but not essentially always opposite, is used. Induction and extraction could operate successfully off the same wall. The area of the wall to be used for ducting is also constructed internally with the vented galvanized steel bracing, but the top of that internal wall has a grill and is open to the roof cavity. The bracing is limited to galvanized steel and other approved building materials for wall bracing may be acceptable. Retro fitting incorporates the same construction as detailed for the induction unit using corner space complete with vents but does not require galvanized steel bracing. Normal construction techniques are sufficient for a retro fit wall unit using timber or steel studs and framing.

The result of warm or cool air being moved so quickly from the internal zones to the roof cavity creates an insulation balance between the internal zone temperatures and the roof cavity. The result is a warmer or cooler environment utilizing the one energy source to supply two benefits.

8. Extractor Vents

The wall cavities to be used for extracting air from within the building also have two identical vents installed, in exactly the same place as the induction vents. Once again, the vents have actuators fitted to them and are operated automatically by the SISACS® Master Control Unit via the CECM when in auto mode. They are hard wired up the duct to a power source in exactly the same manner as the induction vents. Any other convenient power source is acceptable.

9. Operation of the Extraction Vents

When cool air is being inducted into the room via the bottom vent on the induction wall, then the top vent on the extraction wall will open and hot air in the room will be extracted via the suction being created by the SISACS® extraction unit in the roof cavity or on the roof. The hot air being extracted is drawn through the top vent and up into the internal wall duct to the roof cavity where it quickly enters the extractor unit. The air is forced into the extractor chute where it spins an in line fan within the chute that is attached to a magnet alternator before the air is released to the exterior.

When hot air is being inducted into the room via the top vent on the induction wall, then the bottom vent on the extraction wall will open and cold air in the room will be extracted via the extraction wall duct and into the roof cavity where it enters the extractor unit before being forced into the extraction chute. The force of the extracted air drives the alternator fan which is in line in the chute and is attached to a magnet alternator before the spent air is released to the exterior.

10. Wall Monitor

Featured in a convenient place within each zone is fitted a wall monitor. It consists of a small panel fitted with an ambient air quality/air pollution meter, sensors and thermostats, and a smoke alarm sensor. This panel is capable of holding other accessories, for example, an intruder alarm. The purpose of this wall monitoring panel is to provide information on air quality and ambient air temperatures within that zone via an LED display. It does this by using its sensors and thermostats in the panel to read the ambient air conditions within that zone for display on the LED unit and for transmission to the SISACS® Master Control unit. The smoke alarm is a safety feature specific to that zone which will activate on discovery of smoke, also sending a signal to the SISACS® Master Control Unit.

11. Carbon Dioxide Recovery

Fitted to both the inline air streams on induction and extraction is a membrane or other filtration unit or capture device to recover carbon dioxide from the ambient air passing through the SISACS® system. The SISACS® system moves ambient air at between 800 and 1200 liters per second, but ambient air being moved by any other air conditioning system is possible using the SISACS® method. The use of air conditioning to move air over or through a carbon capture device is unique and novel. The SISACS® central electronics control monitor (CECM) is capable of monitoring and counting the liters of ambient air passing over or through the filtration system electronically so a claim on carbon credits can be made. Registration and certification of such a carbon capture system will need to be certified by regulators to accurately assess the carbon, captured from the liters of air counted by the SISACS® CECM.

12. SISACS® Central Electronic Control Monitor: (CECM)

Monitoring and controlling all the functions in the SISACS® system is the CECM. It can be an independent stand alone unit but is most convenient when constructed in conjunction with the MCU and incorporated into one unit. It can be installed on the wall or in any other convenient place. The controller can be operated with blue tooth technology but does not exclude hard wiring or any other existing or yet to be discovered technology capable of sending and/or receiving signals from other units whether wired or not, and whether constructed as one unit with the SISACS® Master Control Unit (MCU) or any other similar device. The SISACS® CECM is not limited to the current functions but has unlimited capacity to be extended to other functionalities as they are developed. The unit when conjoined with the MCU has a LED display, temperature and reset buttons incorporated into its design.

Current Functions:

- Can be manually set for operation in specific zones for ambient temperature
- Automatic setting in one or more than one zone for ambient temperature control.
- Automatic setting for ambient temperature and/or air quality level control and monitoring.
- Receive remote phone call to start or stop the system operating.
- Automatic adjustment of induction and extraction units to obtain maximum efficiency.
- Controls and co-ordinates the opening and closing of all vents to the required setting.
- Receives and reads information constantly being sent from the thermostats in each zone
- Receives and reads information constantly being sent from the air quality sensors in each zone.
- Receives smoke alert signals.
- Automatically shuts down the full SISACS® system and closes all vents if the reset button is not activated within two minutes. Will automatically dial emergency services and provide the phone number and address of the premises sending the call.
- Automatically records liters of air passing over or through the carbon dioxide filtration devices. Every 24 hours sends the information back to a master computer that will track the captured carbon dioxide. (See No 1 Induction Unit and No. 5 Extraction Unit)
- Monitors/records electricity produced by the magnet alternator in the extraction chute.
- The LED screen on the unit provides information on settings and advises if any faults are detected in the system.
- Has technology in the hard drive to monitor and/or control most other currently known electronics operated with blue tooth, infra red, or hard wire that will add to or improve the current invention.

While considerable emphasis has been placed herein on the specific features of the preferred embodiment, it will be appreciated that many additional features can be added and that many changes can be made in the preferred embodiment without departing from the principles of the invention. These and other changes in the preferred embodiment of the invention will be apparent to those skilled in the art from the disclosure herein, whereby it is to be distinctly understood that the foregoing descriptive matter is to be interpreted merely as illustrative of the invention and not as a limitation.

The claims defining the invention are as follows:

1. An integrated system comprising a central electronic control and monitoring (CECM) unit;

a twin chamber wall unit; (TCWU) and a master control unit (MCU), the CECM controls and monitors all electronic functions of the system, the TCWU regulates the flow of air in and out of an environmental zone and the MCU is the programming device to the CECM wherein the TCWU comprises two external or internal wall columns A and B, wherein column A comprises an air induction system and comprises a first top vent and a first bottom vent, wherein column B comprises an air extraction system and comprises a second top vent and a second bottom vent, and wherein (a) during warm exterior temperature operation the second top vent will open automatically on activation and the hot air entrapped in the environmental zone, and which has risen, will be extracted out of the environmental zone; and wherein, simultaneously, the first bottom vent will open automatically on activation introducing cool air into the environmental zone, pushing the warm air upwards, as the extraction system pulls the cooler air upwards at the same time; and (b) during cool exterior temperature operation the second bottom vent will open automatically on activation and the cold air in the environmental zone will be extracted out of the environmental zone; and wherein, simultaneously, the first top vent will open automatically on activation introducing warm air into the environmental zone, pushing the cold air downwards, as the extraction system pulls the cold air out through the second bottom vent at the same time.

2. The system according to claim 1 wherein the flow of air is controlled by the extraction and induction systems which are working together through the CECM.

3. The system according to claims 1 wherein the TCWU signals the CECM to activate an air conditioner to achieve and maintain a desired temperature.

4. The system according to claim 1 wherein the TCWU signals the CECM to activate a heater to achieve and maintain a desired temperature.

5. The system according to claim 3 wherein the TCWU signals the CECM to activate a reverse cycle air or any other conditioning unit to achieve and maintain a desired temperature.

6. A method of purifying air in a room comprising a system according to claim 1.

7. The system according to claim 1 wherein the TCWU further comprises an intruder alarm.

8. The system according to claim 1 wherein the TCWU further comprises a closed circuit television.

9. The system according to claim 1 wherein the integrated system refreshes interior zones of a premise on a regular basis.

10. The system according to claim 7 wherein the intruder alarm comprises one LED row of lights or other visual warning device on the TCWU panel and a directional intruder alarm.

11. The system according to claim 1 further comprising a filtration system for carbon dioxide or other obnoxious gases.

12. The system according to claim 1 further comprising a kinetic energy source generated by the expulsion of air from a unit such as an extractor enabling production of electricity captured by an in line fan attached to a magnet alternator or similar device.

13. The system according to claim 12 wherein a carbon dioxide capture system is fitted to both inline ambient air streams on induction and extraction and a membrane or other filter or capture device designed to recover or collect carbon dioxide from the ambient air passing through, over or around the filter.

14. The system according to claim 13 wherein the central electronic control and monitoring unit (CECM) is capable of monitoring and relaying the liters of ambient air passing over or through the filter and/or monitoring a carbon dioxide capture filtration system electronically to claim carbon credits.

15. An integrated cooling and/or heating induction system which is controlled by electronic unit which monitors the flow of clean air into a room and regulates and controls the air temperature in an interior environment zone, the system comprising an extraction system producing a kinetic energy source created by the expulsion of air from an extractor unit enabling production of electricity by an in line fan attached to a magnet alternator or similar device.

16. The system according to claim 15 comprising:

a central electronic control and monitoring (CECM) unit;

a twin chamber wall unit; (TCWU) and a master control unit (MCU), wherein the CECM controls and monitors all electronic functions of the invention, the TCWU regulates the flow of air in and out of the environment zone and the MCU is the programming device to the CECM.

17. The system according to claim 16 further comprising a filtration system for carbon dioxide or other obnoxious gases.

18. The system according to claim 1 comprising automatic opening vents consisting of moving louvres activated by an actuator that receives its signals from the CECM to open and shut in order to seal air from entering a room when closed, wherein the louvres are angled specifically to feed the maximum amount of air into an enclosed space without creating a draft and are independently controlled through the CECM.

19. The system according to claim 18 wherein the vents close to a sealed position to stop oxygen entering the room in the event of a fire.

20. The system according to claim 19 wherein the vents automatically shut, seal, and turn off all air conditioning systems when a specific signal is received through the CECM from a smoke alarm system.

21. The system according to claim 20 where the smoke alarm system sends out an audible alarm which if not answered within a pre-programmed time frame, then automatically sends an emergency call to a response centre.

22. A system according to claim 1 further comprising a water from air technology unit which inducts outdoor ambient air at a desirable flow rate wherein the unit efficiently cools and separates the water vapour from the inducted air thereby leaving the dry air stream to be captured and redirected, whilst syphoning off the water stream into a holding tank for distribution to the water filtration unit and for use as a potable water supply.

23. The system according to claim 22 wherein the captured dry air stream from the water from air technology unit is continuously ducted directly into an advanced evaporative air conditioning system, so that the inducted continuous dry air supply produces a cool air stream from the evaporative air conditioner.

24. The system according to claim 2 wherein the induction system produces up to 1000 liters of 100% filtrated clean air per second.

25. The system according to claim 1 further regulating the temperature by balancing the temperature in a roof cavity of the environmental zone with a temperature similar to internal parts of the environmental zone by the extraction system moving either warm or cool internal air into the roof cavity through the TCWU in each room before expelling it outside.

* * * * *